US011382402B2

(12) United States Patent
King

(10) Patent No.: US 11,382,402 B2
(45) Date of Patent: Jul. 12, 2022

(54) WATER BOTTLE WITH INTEGRAL PHONE HOLDER

(71) Applicant: James King, Frederick, MD (US)

(72) Inventor: James King, Frederick, MD (US)

( * ) Notice: Subject to any disclaimer, the term of this patent is extended or adjusted under 35 U.S.C. 154(b) by 268 days.

(21) Appl. No.: 16/806,517

(22) Filed: Mar. 2, 2020

(65) Prior Publication Data

US 2020/0275764 A1 Sep. 3, 2020

Related U.S. Application Data

(60) Provisional application No. 62/813,070, filed on Mar. 3, 2019.

(51) Int. Cl.
*A45F 3/16* (2006.01)
*B65D 23/12* (2006.01)

(52) U.S. Cl.
CPC ..... *A45F 3/16* (2013.01); *B65D 23/12* (2013.01); *A45F 2200/0516* (2013.01)

(58) Field of Classification Search
CPC .... A45F 3/16; A45F 2200/0516; A45F 13/30; B65D 23/12
See application file for complete search history.

(56) References Cited

U.S. PATENT DOCUMENTS 1,856,550 A * 5/1932 Guenard ..... B65D 23/12 40/310
4,235,343 A * 11/1980 Thompson ..... B65D 21/0237 215/10
D288,743 S * 3/1987 Taylor ..... 224/222
D362,540 S * 9/1995 McNamara ..... D3/215
D469,249 S * 1/2003 Cain ..... D3/215
6,568,574 B2 * 5/2003 Jones ..... A45C 1/04 224/219
6,629,628 B1 * 10/2003 Canepari ..... A45C 1/04 150/112
D642,792 S * 8/2011 Tremblay ..... D3/218
8,328,055 B1 * 12/2012 Snyder ..... A45F 5/00 224/197
8,662,362 B1 * 3/2014 Bastian ..... H04B 1/3888 224/218
9,290,302 B2 * 3/2016 Horn ..... A61J 7/0481
9,932,147 B1 * 4/2018 Ahlm ..... B65D 21/0237
D861,331 S * 10/2019 Appiah ..... D3/218
10,954,035 B2 * 3/2021 Fromme ..... B65D 1/06
11,071,364 B1 * 7/2021 Fowler ..... A45C 11/00
2004/0226904 A1 * 11/2004 Schroeder ..... B65D 21/0231 215/6
2005/0081879 A1 * 4/2005 Andrion ..... B65D 23/12 132/308

(Continued)

*Primary Examiner* — Ernesto A Grano
(74) *Attorney, Agent, or Firm* — Dingman IP Law, PC; Brian M. Dingman

(57) ABSTRACT

An assembly with a container comprising a sidewall and a recess in the sidewall, the recess comprising a top portion and a bottom portion, and structure that is configured to releasably retain a phone with two ends in the recess. The structure includes a first flexible strap that encircles the bottle and overlies part of the recess, the first strap comprising an integral first receptacle located in or over the recess that is configured to hold one end of the phone, and a second receptacle in or over either the top or bottom portion of the recess and that is configured to hold the other end of the phone.

20 Claims, 2 Drawing Sheets

(56) References Cited

U.S. PATENT DOCUMENTS

2006/0131188 A1* 6/2006 Lindemann ..... B65D 21/0202 206/217
2008/0017678 A1* 1/2008 Anderson ..... A44C 5/003 224/221
2008/0142520 A1* 6/2008 Morgan ..... B65D 23/12 220/254.3
2008/0149589 A1* 6/2008 Lach ..... B65D 23/12 215/386
2008/0230504 A1* 9/2008 Nowzari ..... B65D 1/04 215/6
2008/0230508 A1* 9/2008 Overgaard ..... F25D 31/007 215/386
2008/0308521 A1* 12/2008 Caporaso ..... B65D 21/0237 215/383
2009/0045192 A1* 2/2009 Woolf ..... B65D 81/3205 220/23.87
2010/0006534 A1* 1/2010 Dlouhy ..... B65D 23/12 215/383
2010/0300913 A1* 12/2010 Goldburt ..... B65D 81/36 206/459.1
2010/0327030 A1* 12/2010 Yang ..... A45F 5/00 224/199
2012/0074184 A1* 3/2012 Morgan ..... A45F 5/00 224/222
2012/0138647 A1* 6/2012 Norling ..... A45F 5/00 224/267
2014/0263487 A1* 9/2014 Conwell ..... A45F 3/18 224/148.1
2014/0374370 A1* 12/2014 Nowzari ..... B65B 5/06 215/6
2016/0037892 A1* 2/2016 Facer ..... A45D 34/00 206/581
2016/0198877 A1* 7/2016 Ni ..... B65D 23/12 455/575.1
2017/0225833 A1* 8/2017 Ni ..... H02J 7/0021
2019/0101278 A1* 4/2019 Lynch ..... F21V 17/02
2019/0208898 A1* 7/2019 Koo ..... B65D 23/104
2019/0223580 A1* 7/2019 Wasylko ..... A45F 3/14
2020/0189793 A1* 6/2020 Clifford ..... B65D 21/0237
2021/0130040 A1* 5/2021 Sanders ..... B65D 23/0842
2021/0204664 A1* 7/2021 Fromme ..... B65D 23/12
2021/0218267 A1* 7/2021 Zhijian ..... H02J 7/0042
2021/0316900 A1* 10/2021 Burt ..... B65D 51/242

* cited by examiner

WATER BOTTLE WITH INTEGRAL PHONE HOLDER

CROSS-REFERENCE TO RELATED APPLICATION

This application claims priority of Provisional Application 62/813,070 filed on Mar. 3, 2019.

BACKGROUND

Many people carry smartphones and desire to have the phone with them and accessible during exercise sessions. However, most times people don't want to carry their phone on their person while they exercise. Accordingly, phones are often carried in bags or put away in a secure location such as a locker (and so are not immediately useful), or left somewhere nearby (where they are unsecured and so can be picked up by another person). Phones can also be carried by an armband, where they cannot be seen or easily manipulated.

SUMMARY

Featured in this disclosure is an assembly that includes a container (e.g., a water bottle) and a phone holder that is configured to hold a smartphone in a receptacle in the bottle, where the phone is held such that its screen is facing out, and is both visible to the user and accessible to the touch of the user. Accordingly the phone can be seen and used, if desired, while held by the bottle.

In an aspect an assembly includes a container comprising a sidewall and a recess in the sidewall, the recess comprising a top portion and a bottom portion, and structure that is configured to releasably retain a phone with two ends in the recess. The structure includes a first flexible strap that encircles the bottle and overlies part of the recess, the first strap comprising an integral first receptacle located in or over the recess that is configured to hold one end of the phone, and a second receptacle in or over either the top or bottom portion of the recess and that is configured to hold the other end of the phone.

In some examples the first strap is configured to be moved up and down along a portion of the height of the bottle. In some examples the assembly further comprises a second strap that encircles the bottle and overlies part of the recess, the second strap comprising the second integral receptacle. In an example the second strap is configured to be moved up and down along a portion of the height of the bottle. In some examples the first strap, the first receptacle, and the second receptacle are pliable. In an example the first strap, the first receptacle, and the second receptacle are made from an elastomer.

In some examples the first receptacle comprises a first tapered slot. In an example the second receptacle comprises a second tapered slot. In an example the first and second slots are both open to the recess and have an end, and their openings are wider than their ends, such that the slots are inwardly tapered, to present a variable width than can accommodate phones of different thicknesses. In some examples the recess has a width, height and depth that is sufficient to fully encompass a smartphone. In some examples the second receptacle is part of a second strap.

In some examples the second receptacle is located in the recess. In an example the second receptacle is located in the bottom of the recess. In some examples at least one of the receptacles comprises a slot having a cutout in a front face of the slot. In some examples the second receptacle is part of a bottom cup-shaped member that fits over a bottom of the container. In some examples the assembly further comprises a foldable external stand at a bottom of the container. In an example the stand is movable from a stowed position to a deployed position. In an example in the deployed position the stand holds the recess at about a 15 degree angle from vertical. In an example the assembly further comprises a bottom recess proximate a bottom of the container, wherein in the stowed position the stand is located in the bottom recess.

In another aspect an assembly includes a container comprising a sidewall and a recess in the sidewall, the recess comprising a top portion and a bottom portion and structure that is configured to releasably retain a phone with two ends in the recess. The structure includes a first pliable strap that encircles the bottle, overlies part of the recess, and is configured to be moved up and down along a portion of the height of the bottle, the first strap comprising an integral first pliable receptacle located in or over the recess that is configured to hold one end of the phone, and a second pliable receptacle in or over either the top or bottom portion of the recess and that is configured to hold the other end of the phone. At least one of the receptacles comprises a slot having a cutout in a front face of the slot.

DETAILED DESCRIPTION

Figure 1A:
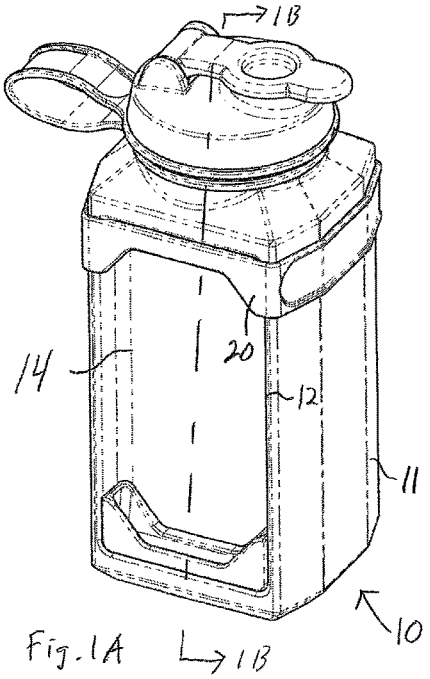
FIG. 1A is a perspective view of an assembly that includes a water bottle and a phone holder.
Figure 1B:
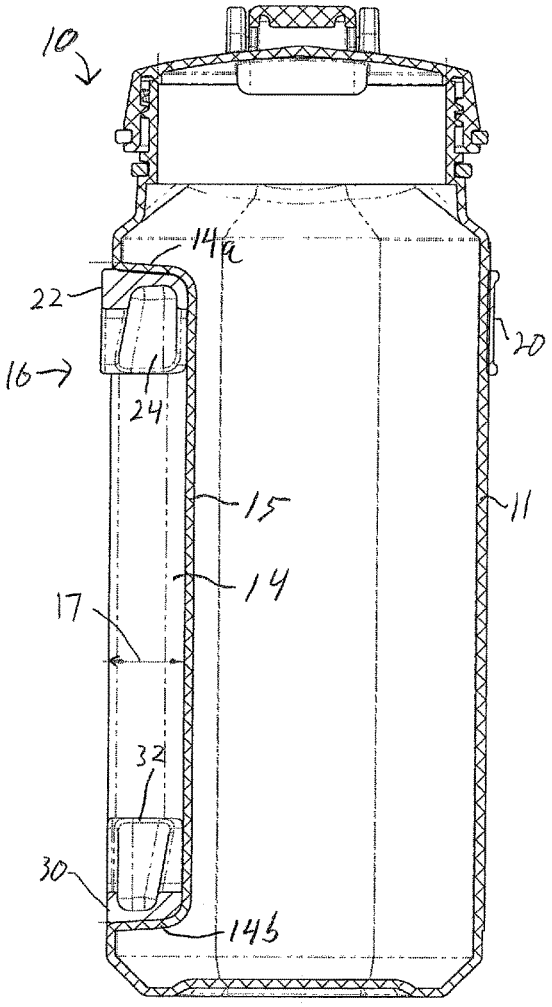
FIG. 1B is a cross-sectional view taken along line 1B-1B, FIG. 1A.

Assembly 10 with bottle/container 11 is shown in FIGS. 1A and 1B. It should be understood that many details of the illustrated examples are not limiting of the scope of the invention. Rather, the variations exemplify aspects of the invention. Also, the cap and other aspects that are conventional are not fully described herein.

Bottle 11 is generally configured to be used as a refillable water bottle of the type that is often used during exercise. Bottle 11 can be made from ABS or another plastic material. Bottle 11 has at least one side 12 that is generally flat, so that it has a height and width that is sufficient to carry most smartphones. As shown the bottle may have four generally flat sides, but that is not necessary.

Side 12 includes a recess 14 molded into the bottle. Recess 14 is formed in effect by moving all or part of side 12 (i.e., wall 15, FIG. 1B) inward from its nominal position where it would be co-planar with both edges of the side. Recess 14 has a width, height and depth 17 that is sufficient to fully encompass some smartphones. Recess 14 is bounded at its top end by wall 14*a* and at its lower end by wall 14*b*. A smartphone can thus fit in recess 14. Preferably but not necessarily the recess has a depth 17 that keeps the phone screen within the recess, although the phone could potentially have its screen project slightly from the recess. In one non-limiting embodiment the recess depth 17 is 0.70 inches.

In an embodiment, assembly 10 includes structure 16 that is configured to releasably retain a phone in the bottle recess. This structure can include a flexible strap 20 that encircles the bottle and overlies part of the recess. Strap 20 is preferably movable up and down along some of the height of the bottle, so that it can be arranged to hold one end of the phone. This can be accomplished by the strap being in a slightly stretched condition so that it grips the bottle, but can be pushed up and down as necessary. Strap 20 can be configured to hold either the top of the phone (as in FIGS. 1A and 1B) and/or the bottom of the phone (as in FIGS. 2 and 3). Strap 20 integrally includes first receptacle 22 that is located in recess 14 and is configured to hold one end of a phone in a slot 24 in the receptacle. The movable strap functions as a means to allow receptacle 22 to be positioned at a desired height along the height of the bottle so that it is properly aligned with either the top or bottom end of the phone.

Structure 16 also includes second receptacle 30 that is held at either the top or bottom of the recess. Receptacle 30 can be held to the bottle in a desired fashion, such as with an adhesive, an appropriate mechanical structure such as a fastener, or by overmolding the bottle material over the receptacle, for example. Alternatively, receptacle 30 can be an integral part of a second strap that is like strap 20; see strap 74, FIG. 2. The second strap can be fixed in place on the bottle or can be movable like strap 20. Receptacle 30 is configured to hold one end of a phone (the end that is not held by receptacle 22) in a slot 32 in the receptacle. Receptacle 30 may be but need not be the same as receptacle 22.

Both receptacles (and the strap that is integral with one or both of the receptacles) are preferably made of a flexible material with some compliance (such as an elastomer such as silicone rubber), and the slots in the receptacles preferably have a relaxed width that is slightly less than the thickness of a phone so that the ends of the phone create an interference fit in the slots. This optional aspect of the slots will tightly hold both ends of the phone so it is more securely retained in recess 14. More variation in the thicknesses of the phones that can fit into the slots can be accomplished by tapering the slots, as shown in the FIG. 1B. The taper, which is optional, can be such that the slot opening is wider than its end. The slots can have a closed end, or the end can be open. Because of the taper, the slots have a variable width. The variation in width can be configured to accomplish a maximum width that is about the same as the thickness of thicker phones, and a minimum width that is about the same as the thickness of thinner phones.

Figure 2:
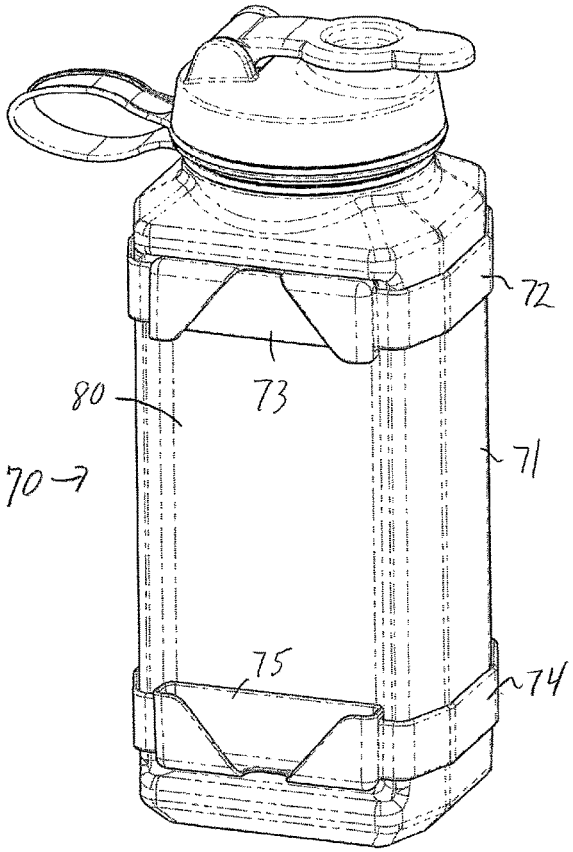
FIG. 2 is a perspective view of another assembly that includes a water bottle and a phone holder.

A slightly different example is shown in FIG. 2. Assembly 70 includes bottle 71 with recess 80. In this example, straps 72 and 74 and their integral receptacles 73 and 75 are identical, and both can be moved up and down along the height of the bottle to accommodate phones of different heights. Also, receptacles 73 and 75 are slightly different in shape as compared to the other receptacles illustrate in FIGS. 1A, 1B, and 3.

Figure 3:
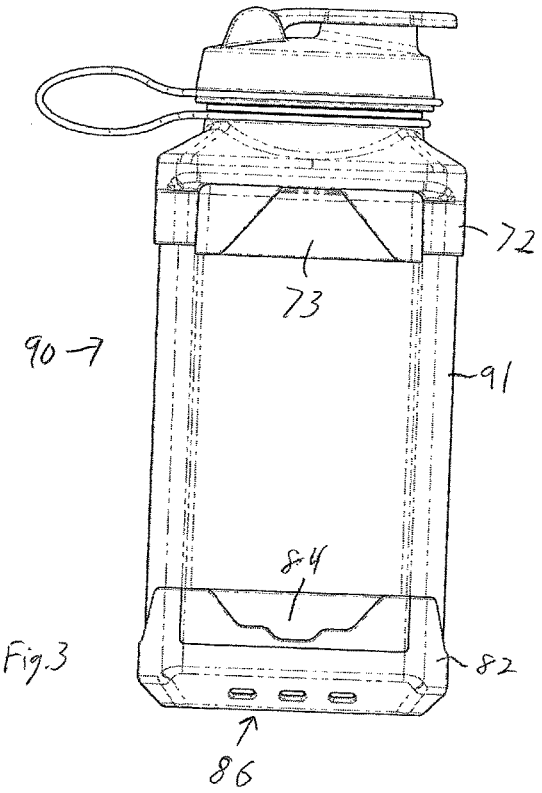
FIG. 3 is a front view of another assembly that includes a water bottle and a phone holder.

FIG. 3 illustrates another example of assembly 90 with bottle 91, where upper strap 72 and its integral receptacle 73 are the same as that of FIG. 2. Bottom receptacle 82 has a different cutout shape 84 that might be better to accommodate access to lower "home" buttons of some phones.

Figure 4:
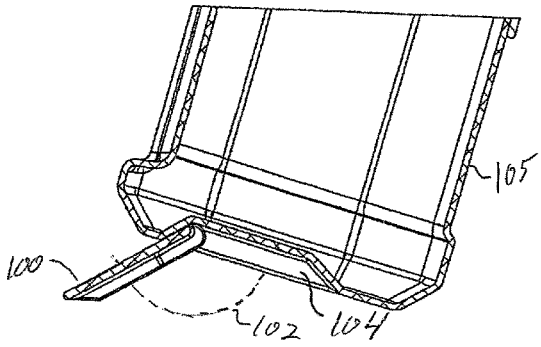
FIG. 4 is a partial cross-sectional view of the bottom of another assembly that includes a water bottle and a phone holder.

FIG. 4 illustrates an optional foldable stand 100 (like a kickstand) that can be deployed to hold the bottle at an angle from the vertical. The stand in this non-limiting example folds or pivots fully into a cavity 104 in the bottom of the bottle 105 so that the bottom is flat when stand 100 is stowed in cavity 104. Stand 100 then folds/pivots out along path 102 to hold the bottle at an angle of about fifteen degrees. This option can hold the bottle at a better angle for viewing the phone held on the bottle.

Figure 5:
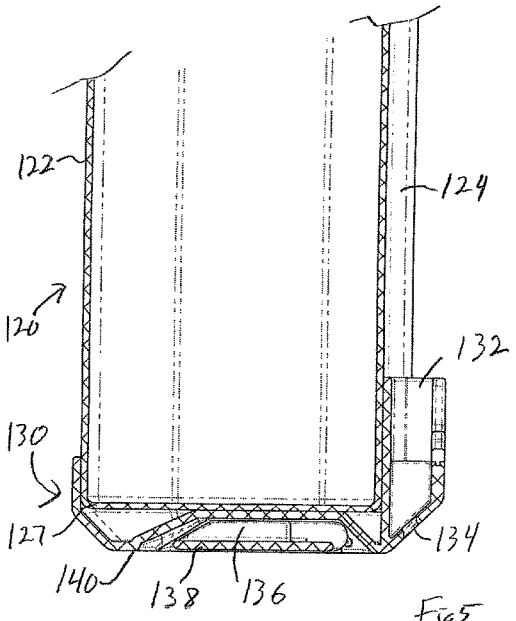
FIG. 5 is a partial cross-sectional view of the bottom of another assembly that includes a water bottle and a phone holder.

FIG. 5 illustrates another assembly 120 with bottle 122 with recess 124. The lower phone receptacle 132 in this example is an integral part of bottom cup-shaped member 130 that fits over the bottom 127 of bottle 122. One or more weep holes 134 are molded into receptacle 132 to allow water to drain out of the receptacle, so that any spilled water is less likely to impact the phone. Also in this example deployable stand 138 is, in the stowed position illustrated in FIG. 5, located in recess 136 in the bottom 140 of member 130.

A number of implementations have been described. Nevertheless, it will be understood that additional modifications may be made without departing from the scope of the inventive concepts described herein, and, accordingly, other examples are within the scope of the following claims.

What is claimed is:

1. An assembly, comprising:

a container comprising a sidewall and a recess in the sidewall, the recess comprising a top portion and a bottom portion; and structure that is configured to releasably retain a phone with two ends in the recess, the structure comprising a first flexible strap that encircles the bottle and overlies part of the recess, the first strap comprising an integral first receptacle located in or over the recess that is configured to hold one end of the phone, and a second strap that encircles the bottle and overlies part of the recess, the second strap comprising a second receptacle in or over either the top or bottom portion of the recess and that is configured to hold the other end of the phone.

2. The assembly of claim 1, wherein the first strap is configured to be moved up and down along a portion of the height of the bottle.

3. The assembly of claim 1, wherein the second strap is configured to be moved up and down along a portion of the height of the bottle.

4. The assembly of claim 1, wherein the first strap, the first receptacle, and the second receptacle are pliable.

5. The assembly of claim 4, wherein the first strap, the first receptacle, and the second receptacle are made from an elastomer.

6. The assembly of claim 1, wherein the first receptacle comprises a first tapered slot.

7. The assembly of claim 6, wherein the second receptacle comprises a second tapered slot.

8. The assembly of claim 7, wherein the first and second slots are both open to the recess and have an end, and wherein their openings are wider than their ends, such that the slots are inwardly tapered, to present a variable width than can accommodate phones of different thicknesses.

9. The assembly of claim 1, wherein the recess has a width, height and depth that is sufficient to fully encompass a smartphone.

10. The assembly of claim 1, wherein the second receptacle is part of a second strap.

11. The assembly of claim 1, wherein the second receptacle is located in the recess.

12. The assembly of claim 11, wherein the second receptacle is located in the bottom of the recess.

13. The assembly of claim 1, wherein at least one of the receptacles comprises a slot having a cutout in a front face of the slot.

14. The assembly of claim 1, wherein the second receptacle is part of a bottom cup-shaped member that fits over a bottom of the container.

15. The assembly of claim 1, further comprising a foldable external stand at a bottom of the container.

16. The assembly of claim 15, wherein the stand is movable from a stowed position to a deployed position.

17. The assembly of claim 16, wherein in the deployed position the stand holds the recess at about a 15 degree angle from vertical.

18. The assembly of claim 16, further comprising a bottom recess proximate a bottom of the container, wherein in the stowed position the stand is located in the bottom recess.

19. An assembly, comprising:

a container comprising a sidewall and a recess in the sidewall, the recess comprising a top portion and a bottom portion; and structure that is configured to releasably retain a phone with two ends in the recess, the structure comprising a first flexible strap that encircles the bottle and overlies part of the recess, the first strap comprising an integral first receptacle located in or over the recess that is configured to hold one end of the phone, wherein the first receptacle comprises a first tapered slot, and a second receptacle in or over either the top or bottom portion of the recess and that is configured to hold the other end of the phone.

20. An assembly, comprising:

a container comprising a sidewall and a recess in the sidewall, the recess comprising a top portion and a bottom portion; and structure that is configured to releasably retain a phone with two ends in the recess, the structure comprising a first flexible strap that encircles the bottle and overlies part of the recess, the first strap comprising an integral first receptacle located in or over the recess that is configured to hold one end of the phone, and a second receptacle in or over either the top or bottom portion of the recess and that is configured to hold the other end of the phone, wherein the second receptacle is part of a bottom cup-shaped member that fits over a bottom of the container.

* * * * *